United States Patent [19]

Gorondy

[11] 4,421,515

[45] * Dec. 20, 1983

[54] PRINTING PROCESS

[75] Inventor: Emery J. Gorondy, Chadds Ford, Pa.

[73] Assignee: E.I. Du Pont de Nemours & Co., Wilmington, Del.

[ * ] Notice: The portion of the term of this patent subsequent to Dec. 20, 2000 has been disclaimed.

[21] Appl. No.: 392,787

[22] Filed: Jun. 28, 1982

[51] Int. Cl.[3] ..... D06P 5/20

[52] U.S. Cl. ..... 8/444; 8/471; 8/512; 8/922

[58] Field of Search ..... 8/471, 444

[56] References Cited

U.S. PATENT DOCUMENTS

| | | | |
|---|---|---|---|
| 3,860,388 | 1/1975 | Haigh | 8/2.5 |
| 3,915,628 | 10/1975 | Bossard et al. | 8/2.5 |
| 4,099,186 | 7/1978 | Edwards et al. | 346/74.1 |
| 4,117,498 | 9/1978 | Edwards et al. | 346/74.1 |
| 4,124,384 | 11/1978 | Centa | 96/14 |
| 4,145,300 | 3/1979 | Hendriks | 252/62.1 |
| 4,246,331 | 1/1981 | Mehl et al. | 430/107 |

*Primary Examiner*—A. Lionel Clingman

[57] ABSTRACT

A process is described for dyeing a textile material, comprising the steps of: forming a latent magnetic image in a magnetic imaging member comprising a ferromagnetic material on an electrically conductive support; developing the magnetic image by applying thereto a ferromagnetic toner comprising a ferromagnetic component, a dye component containing a dye which is substantially sublimable at from 160° C. to 215° C., and a resin, which substantially encapsulates the ferromagnetic component and the dye component; transferring the developed image to a first surface of a thermally stable sublimable-dye-permeable polymeric film; bringing the polymeric film on a second surface thereof into contact with a textile material to be dyed; heating the textile material and polymeric film to thereby transfer the dye image from the first surface of the polymeric film through the polymeric film to form a dye image in the textile material.

7 Claims, 1 Drawing Figure

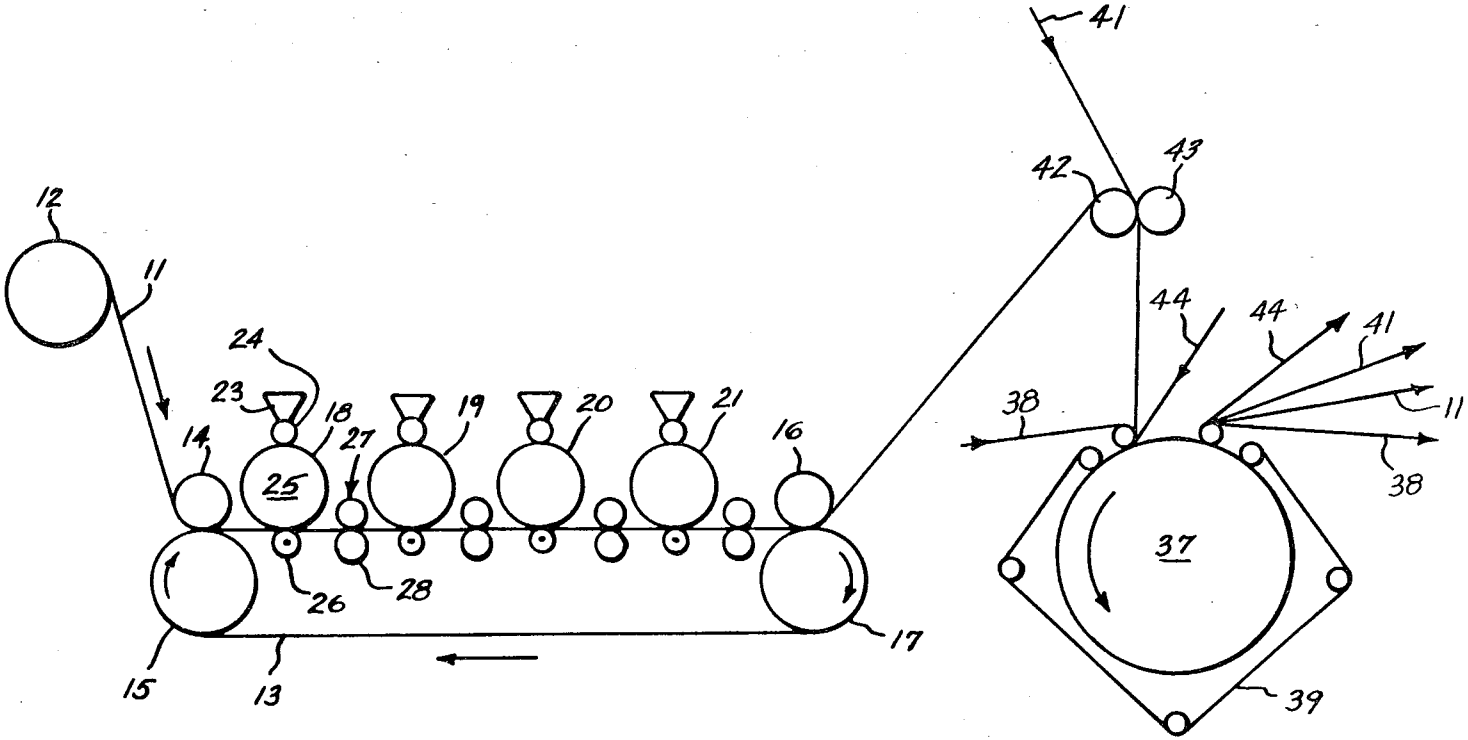
12
11
14
23
24
18
27
25
26
28
19
20
21
16
17
15
13
41
42
43
44
44
38
37
39
41
11
38

PRINTING PROCESS

BACKGROUND OF THE INVENTION

1. Field of the Invention

This invention relates to a process for printing dye onto textile material. More particularly, the process relates to forming a dye image of a sublimable dye by magnetic printing, and transferring the dye image to a textile material by sublimation thereof.

2. Description of the Prior Art

In the conventional printing of textile materials, normally the textile material or fabric is glued to a printing blanket that transports it under the printing rolls or screens. After all colors have been applied, the fabric is oven dried, then the dyes are fixed, e.g., by hot air or high-pressure high-temperature steam. The textiles are then scoured and dried. In structurally unstable fabrics, such as polyester double knit materials, waste due to inadequate registration of the different colors may amount to 20–30%, which is very unsatisfactory.

Magnetic printing processes, particularly useful in overcoming the problem in electrostatic copying processes of unsatisfactory copying of large dark areas, are known in the art. Such processes are described, for instance, in U.S. Pat. Nos. 4,099,186 and 4,117,498. The particular processes described in U.S. Pat. Nos. 4,099,186 and 4,117,498 relate to processes wherein a dye and/or other chemical treating agent contained in a ferromagnetic toner is transferred directly to a substrate, e.g., such as a textile material, or is transferred to a first substrate, such as paper, for subsequent transfer to a final substrate. The difference in the processes of U.S. Pat. Nos. 4,099,186 and 4,117,498 is that the former includes a step of subjecting the ferromagnetic materials to the action of a charge dissipating means.

U.S. Pat. No. 3,860,388 describes a method of dye absorption into the surfaces of plastics by placing a polyethylene film between a dye transfer paper and a sheet of plastic and applying pressure and heat thereto. The dyes sublime through the polyethylene film to the plastic film to be dyed.

U.S. Pat. No. 3,915,628 related to a continuous dry transfer-printing process for textile webs wherein a continuous inert carrier, advantageously stainless steel, aluminum or paper, is applied to the surface of the web, which is then contacted with the material to which the dye is to be transferred, followed by heating and sublimation of the dye.

SUMMARY OF THE INVENTION

According to the process of the invention, a magnetic dye image is formed on a magnetic imaging member. The thus formed magnetic dye image is transferred first to a surface of a thermally stable, disperse-dye-permeable polymeric film, and the dye is subsequently sublimed through the film to a textile material that has been brought into contact with the film on the opposite surface from the surface to which the magnetic image has been transferred, to thereby form a dye image in the textile material.

More specifically, the process of the invention comprises the steps of: forming a magnetic image on a magnetic imaging member comprising a ferromagnetic material imposed on an electrically conductive support; developing the magnetic image by applying a ferromagnetic toner comprising a ferromagnetic component, a dye component containing a dye that is substantially sublimable at from 160° to 215° C., and a resin, which substantially encapsulates the ferromagnetic component and the dye component; transferring the developed image to a first surface of a thermally stable, disperse-dye-permeable polymeric film; bringing the polymeric film into contact on a second surface thereof with a sublimable dye dyeable material such as a textile or film (hereinafter referred to as a textile material) to be dyed, such that the developed image on the first surface of the polymeric film is on the opposite side of the polymeric film from the second surface in contact with the textile material; heating the textile material and the polymeric film to cause substantial sublimation of the dye component of the toner, thereby transferring said dye image from the first surface of the polymeric film through the polymeric film to form a dye image in the textile material.

BRIEF DESCRIPTION OF THE DRAWING

The Drawing is an illustrative diagram of an apparatus useful for practicing the process of the invention.

DETAILED DESCRIPTION OF THE INVENTION

The formation of a magnetic image on a ferromagnetic material imposed on an electrically conductive support can be accomplished by techniques known in the art of magnetic recording. Examples of such techniques are described in U.S. Pat. Nos. 4,099,186 and 4,117,498, the disclosures of which are incorporated herein by reference.

In the invention the magnetic image is developed by applying a ferromagnetic toner comprising a ferromagnetic component, a dye component which is substantially sublimable at from 160° to 215° C., and a resin, which preferably is water soluble or water solubilizable, which substantially encapsulates the ferromagnetic component and the dye component.

The ferromagnetic component of the ferromagnetic toner can consist of hard magnetic particles, soft magnetic particles, or a binary mixture of hard and soft magnetic particles. Such particles are described in U.S. Pat. Nos. 4,099,186 and 4,117,498.

The dye component used in the ferromagnetic toner must be sublimable at a temperature of less than 215° C. Dyes falling into this category include low-energy and medium-energy dyes, with medium-energy dyes being preferred. Examples of such dyes include . . .

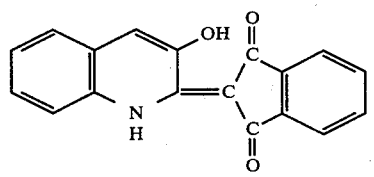

a medium energy yellow disperse dye,

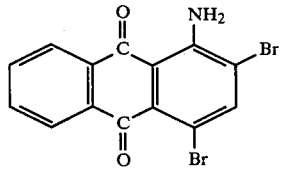

a low to medium energy red disperse dye,

-continued

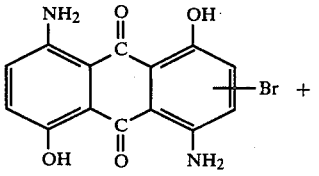

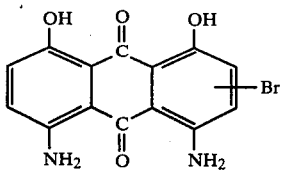

a medium energy blue disperse dye, and

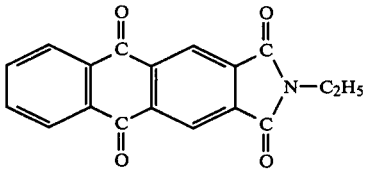

a greenish blue disperse dye.

The concentration of the dye component in the ferromagnetic toner can vary over a range of from about 1.0% to about 10.0% by weight, based on the total weight of the toner. In a preferred embodiment, the concentration of dye component is between 3.0% and 9.0% by weight.

The resin which encapsulates the ferromagnetic component and the dye component of the ferromagnetic toner may be any known, readily fusable, natural, modified natural, or synthetic resin or polymer.

The relative amounts of resinous material and ferromagnetic component in the toner are determined by the desired adhesive and magnetic properties of the toner particle. Generally, a ratio of resinous material to ferromagnetic material of 0.11:1 to 3.3:1 is useful, with the range of 0.40:1 to 1.0:1 being preferred.

Other components may optionally be added to the ferromagnetic toner, such as those described in U.S. Pat. Nos. 4,099,186 and 4,117,498.

In the process of the invention the developed magnetic image is transferred to a first surface of a thermally stable, disperse-dye-permeable polymeric film. In one preferred embodiment, the thermally stable, disperse-dye-permeable polymer film is a polyester film, e.g., Mylar ®. Other polymeric films that may be used in the process of the invention include polyamides, polyvinyl acetate, and cellulose acetate.

Textile materials that can be dyed according to the process of the invention include polymers that are "disperse-dyeable", that is, materials capable of forming a solid solution of the dye in the textile material. Such textile materials include polyesters and nylon, with polyesters, such as poly(ethylene terephthalate), being particularly preferred. An apparatus for carrying out the process of the invention comprises a means for forming a magnetic image on a ferromagnetic material, a means for developing the magnetic image using a ferromagnetic toner, a means for transferring the developed magnetic image from the ferromagnetic material to a first surface of a thermally stable, disperse-dye-permeable polymeric film, means for bringing said polymeric film, on a second surface thereof, into contact with a textile material to be dyed, such that the developed image on the first surface of the polymeric film is on the opposite side of the polymeric film from the second surface in contact with the textile material, and a means for heating the textile material and the polymeric film causing a substantial sublimation of the dye of the dye component, thereby transferring said dye image from the first surface of the polymeric film through the polymeric film to form a dye image on the textile material.

A particular apparatus as described above for carrying out the process of the invention is illustrated in the Drawing. In the Drawing a thermally stable, disperse-dye-permeable polymeric film 11, such as a polyester film, is unrolled from a roller 12 and transported to a continuous support belt 13 and by means of rollers 14, 15, 16 and 17 is transported through a series of magnetic printers 18, 19, 20 and 21 for printing different color images on the polymeric film. The polymeric film may be either clear or may be dyed uniformly with a sublimable dye. In the latter embodiment, a uniform background color can be formed on the textile material to be printed. Each of the magnetic printers comprises a toner box 23, a magnetic decorator roll 24, a print roll 25 on which the image is formed for transfer to the polymeric film, and a D.C. corona or voltage biasing roll 26. After passing the magnetic printers and receiving the printed image transferred from the magnetic printer 18, 19, 20 and 21, the continuous belt and the polyester film are passed through a hot roll fuser 27, 28.

After leaving roller 16, a second thermally stable, sublimable-dye-permeable polymeric film 41 is contacted, between rollers 42 and 43, with the surface of polymeric film 11 on which the developed magnetic image is formed. At this point the polymeric film 11 with the developed magnetic image and covering film 41 may be taken up on a roll and then fed through the remainder of the process as hereinafter described. Then the two polymeric films containing the developed magnetic image sandwiched between are fed between heated rotating cylinder 37 and a continuous pressure belt 39, together with textile material 38, which is fed between the two layer polymeric film and the continuous pressure belt 39, and textile material 44, which is fed between the heated rotating cylinder and the two-layer polymeric film. During passage around the heated rotating cylinder 37, the sublimable dye present in the developed magnetic image is sublimed and permeates through the polymeric films to thereby form dye images on the textile materials corresponding to the dye image printed on the polymeric film.

If it is desired to print on a single textile material a dye impenetratable layer such as aluminized Mylar ® or paper should be laminated to the dye image bearing film.

DESCRIPTION OF THE PREFERRED EMBODIMENTS

Example 1

A yellow toner mix is prepared by mixing 45.0 wt % of

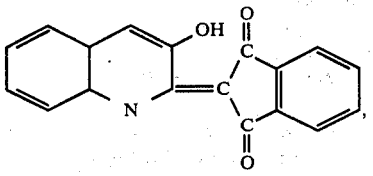

40.0 wt % Carboset XL 11, a terpolymer of methyl methacrylate ethyl acrylate, and acrylic acid having a glass transition number of 55° C. and an acid number of 74 mg KOH/g, a terpolymer of methyl methacrylate ethyl acrylate, 1.5 wt % Reax 85 A lignosulfonate dispersing agent and 53.5 wt % of Magnetic Oxide No. 7029, $Fe_3O_4$ type ferroferric oxide.

A red toner mix is prepared by mixing 7.0 wt %

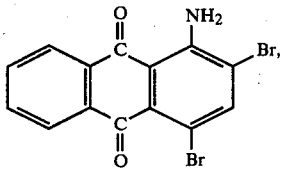

37.61 wt % Carboset XL 11, 1.89 wt % Reax 85 A and 53.50 wt % Magnetic Oxide No. 7029.

A blue toner mix is prepared by mixing 7.0 wt %

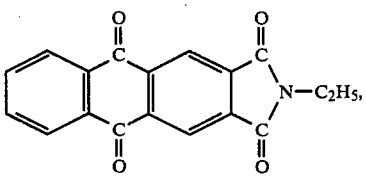

38.1 wt % Carboset, 1.4 wt % Reax 85 A and 53.5 wt % Magnetic Oxide No. 7029.

A black toner mix is prepared by mixing 3.00 wt % of the above yellow dye, 4.50 wt % of the above red dye, 4.00 wt % of the above blue dye, 36,95 wt % of Carboset XL 11, 1.55 wt % Reax 85 A, and 50.00 wt % Magnetic Oxide No. 7029.

The toner mixes are converted into toner by spray drying an aqueous dispersion of the components set forth above.

Each of the magnetic imaging members are formed of a 350μ inches thick layer of acicular chromium dioxide in a binder on an electrically grounded silver-coated rubber roll which is 12 inches (0.3 meter) wide. The magnetic imaging member is magnetically structured to 460 pole reversals/inch (18 pole reversals/mm) or 230 cycles 1 inch (9 cycles/mm) or 55 microns/pole reversal by recording a square wave with a magnetic write head at 35 m Amps and 6 to 8 Volts. A film postive of the individual colors to be printed is placed in contact with the magnetically structured roll and stepwise uniformly illuminated by a Xenon flash at 3.3 KV with a 15° turn per flash, passing through the film positive. The dark areas of the film positive, corresponding to the areas to be printed, absorb the energy of the Xenon flash; whereas the clear areas transmit the light and heat the acicular chromium dioxide beyond a Curie point of about 116° C. thereby demagnetizing the exposed magnetized lines of acicular chromium dioxide. The thusly magnetized rolls are then registered with each other in the apparatus depicted in the FIGURE.

The four toners are individually fed from a slot in the hoppers to decorate the latent magnetic images in each of the magnetic imaging members by a decorator. The decorator comprises a rotating magnetic cylinder inside a non-magnetic sleeve. As the magnetic imaging member rotates after being decorated with toner it first passes an AC corona which serves to neutralize any electrostatic charges which may be adhering toner to the magnetic imaging member. Then, a vacuum knife removes stray toner from the non-image areas. The toner is then negatively charged with a DC corona. The toner is then transferred to a 0.5 mil (0.013 mm) thick polyethylene terephthalate film supported on an endless belt. A negatively charged voltage biasing roll on the backside of the belt is used to effect transfer of the toner from the magnetic imaging member to the film. After toner transfer the imaging member passes in this order, an AC corona, a brush and a vacuum knife to remove any remaining toner, prior to returning to the decorator. This is repeated at each of the remaining printing stations. The toner particles are then coalesced together with a battery of infrared lamps which heat the toner to about 90° C. The film with the toner image is then fed, along with a 0.5 mil (0.013 m) thick poly(ethylene terephthalate) film, between an offset roll maintained at 110° C. and an unheated nip roll on the backside of the film to form a laminate containing the image between the two films.

The laminate is fed, together with a textile fabric on either side, around a drum fitted with internal hot oil heat and external infrared heaters and an endless pressure belt of Teflon ®. The surface of the drum is maintained at 210° C. The first pass around the drum utilizes a residence time of 30 seconds. After passing around the drum the two textile fabrics and the laminate are separately taken up on rolls. The process is repeated using the laminate a second time using a residence time on the drum of 45 seconds and a third time with a residence time on the drum of 60 seconds. The six textile fabrics are all dyed to nearly the same degree and depth of shade. The fabric used is a woven 24 guage 100% poly(ethylene terephthalate) weighing 5.7 oz/yd$^2$ (0.19 Kg/m$^2$).

I claim:

1. A process for dyeing a disperse dyeable textile material comprising the steps of:

forming a latent magnetic image in a magnetic imaging member comprising a ferromagnetic material imposed on an electrically conductive support;

developing the latent magnetic image by applying thereto a ferromagnetic toner comprising a ferromagnetic component, a dye component containing a dye that is substantially sublimable from 160° C. to 215° C., and a resin which is substantially encapsulates the ferromagnetic component and the dye component;

transferring the developed image from the magnetic imaging member to a first surface of a thermally stable, sublimable-dye-permeable first polymeric film;

covering the image with a layer of a material, bringing said polymeric film into contact on a second surface thereof with the disperse dyeable textile material to be dyed, such that the developed image on the first surface of the polymeric film is on the opposite side of the polymeric film from the second surface in contact with the disperse dyeable textile material;

heating the disperse dyeable textile material and the polymeric film to cause substantial sublimation of the dye of said dye component, thereby transferring said dye image from the first surface of the polymeric film through the polymeric film to form a dye image on the disperse dyeable textile material.

2. The process of claim 1 wherein the layer with which the image is covered is a film of sublimable dye permeable material.

3. A process as in claim 2 wherein the ferromagnetic material on the magnetic imaging member is subjected to the action of a charge dissipating means and a means to remove toner from non-image areas of the magnetic imaging member prior to transfer of the magnetic image to the first polymer film.

4. A process as in claim 3 wherein the polymeric film comprises a polyester.

5. A process as in claim 4 wherein the polymeric film is between about 0.006 mm and 0.04 mm thick.

6. A process as in claim 5 wherein the disperse dyeable textile material and the polymeric film are brought into contact between a heated rotating drum and a continuous pressure belt in order to transfer the dye to the disperse dyeable textile material.

7. A process as in claim 6 wherein, after transferring the developed magnetic image to the first surface of the first polymeric film, a second thermally stable, sublimable-dye-permeable polymeric film is positioned in contact with the first surface of the first polymeric film, and disperse dyeable textile materials are brought into contact with both surfaces of the resulting two-layer polymeric film opposite to the surfaces thereof contacting the developed magnetic image, heating said polymeric film and disperse dyeable textile materials at relatively high temperature to cause substantial sublimation of the dye in the dye component of the developed image, thereby transferring said dye through the polymeric films to form dye images on the disperse dyeable textile materials.

* * * * *